US010526165B2

(12) United States Patent
Kuusinen et al.

(10) Patent No.: US 10,526,165 B2
(45) Date of Patent: Jan. 7, 2020

(54) PASSENGER NUMBER BASED CALL ALLOCATION IN AN ELEVATOR SYSTEM

(71) Applicant: KONE Corporation, Helsinki (FI)

(72) Inventors: Juha-Matti Kuusinen, Helsinki (FI); Marja-Liisa Siikonen, Helsinki (FI); Antti Kallioniemi, Jokela (FI)

(73) Assignee: KONE CORPORATION, Helsinki (FI)

( * ) Notice: Subject to any disclaimer, the term of this patent is extended or adjusted under 35 U.S.C. 154(b) by 349 days.

(21) Appl. No.: 15/433,299

(22) Filed: Feb. 15, 2017

(65) Prior Publication Data

US 2017/0158459 A1 Jun. 8, 2017

Related U.S. Application Data

(63) Continuation of application No. PCT/FI2014/050697, filed on Sep. 12, 2014.

(51) Int. Cl.

| | |
|---|---|
| ***B66B 1/18*** | (2006.01) |
| ***B66B 1/24*** | (2006.01) |
| ***B66B 1/46*** | (2006.01) |
| ***B66B 9/00*** | (2006.01) |

(52) U.S. Cl.

CPC ..... *B66B 1/2408* (2013.01); *B66B 1/2458* (2013.01); *B66B 1/468* (2013.01); *B66B 9/00* (2013.01); *B66B 2201/20* (2013.01); *B66B 2201/215* (2013.01)

(58) Field of Classification Search

CPC ..... B66B 1/2408; B66B 1/2458; B66B 1/468; B66B 9/00; B66B 2201/20; B66B 2201/215

USPC ..... 187/247, 380–389, 391, 392, 393, 396

See application file for complete search history.

(56) References Cited

U.S. PATENT DOCUMENTS

| | | | | | |
|---|---|---|---|---|---|
| 5,331,121 | A * | 7/1994 | Tsuji | B66B 1/2408 | 187/388 |
| 5,354,957 | A * | 10/1994 | Robertson | B66B 1/2408 | 187/247 |
| 5,612,519 | A | 3/1997 | Chenais | | |
| 5,672,853 | A * | 9/1997 | Whitehall | B66B 1/2408 | 187/380 |
| 5,841,084 | A * | 11/1998 | Thangavelu | B66B 1/2458 | 187/382 |

(Continued)

FOREIGN PATENT DOCUMENTS

| | | |
|---|---|---|
| EP | 0 565 864 A1 | 10/1993 |
| WO | WO 2005/070804 A2 | 8/2005 |

(Continued)

*Primary Examiner* — Anthony J Salata

(74) *Attorney, Agent, or Firm* — Birch, Stewart, Kolasch & Birch, LLP

(57) ABSTRACT

A method for allocating an elevator in an elevator system constructs passenger batch size distributions for each pair of floors in a building based on passenger batch journeys, each passenger batch journey defining at least the origin and destination floor of the journey, the number of passengers relating to the journey and the time of the journey; receives a call for an elevator; estimates the number of passengers waiting behind the call based on the passenger batch size distributions; and allocates the call to an elevator being able to serve the estimated number of passengers.

20 Claims, 2 Drawing Sheets

(56) References Cited

U.S. PATENT DOCUMENTS

| | | | | |
|---|---|---|---|---|
| 6,325,178 | B2 * | 12/2001 | Hikita | B66B 1/2458 187/382 |
| 6,394,232 | B1 * | 5/2002 | Iwata | B66B 1/2458 187/247 |
| 6,553,269 | B1 * | 4/2003 | Hikita | B66B 1/2408 187/247 |
| 6,672,431 | B2 * | 1/2004 | Brand | B66B 1/2458 187/247 |
| 6,913,117 | B2 * | 7/2005 | Tyni | B66B 1/20 187/382 |
| 6,945,365 | B2 * | 9/2005 | Matela | B66B 1/20 187/247 |
| 7,014,015 | B2 * | 3/2006 | Nikovski | B66B 1/2458 187/247 |
| 7,546,906 | B2 * | 6/2009 | Tyni | B66B 1/2458 187/382 |
| 8,104,585 | B2 * | 1/2012 | Smith | B66B 1/2458 187/247 |
| 2019/0106289 | A1 * | 4/2019 | Kuusinen | B66B 1/2458 |

FOREIGN PATENT DOCUMENTS

| | | | |
|---|---|---|---|
| WO | WO 2009/122002 | A1 | 10/2009 |
| WO | WO 2014/111127 | A1 | 7/2014 |

* cited by examiner

PASSENGER NUMBER BASED CALL ALLOCATION IN AN ELEVATOR SYSTEM

CROSS REFERENCE TO RELATED APPLICATIONS

This application is a Continuation of PCT International Application No. PCT/FI2014/050697, filed on Sep. 12, 2014, which is hereby expressly incorporated by reference into the present application.

TECHNICAL FIELD

The disclosure relates to call allocation in an elevator system.

BACKGROUND

Elevators are normally allocated based on two allocation methods: continuous allocation or immediate allocation.

In continuous allocation a passenger places a call by pushing an up/down button. With continuous allocation one cannot know for sure how many passengers are actually waiting behind a single call. The number of passengers waiting behind a landing call may be estimated, for example, by multiplying the estimated time of arrival to the call with the passenger arrival intensity obtained from historical or forecasted traffic statistics. The result of the multiplication describes the number of passengers waiting behind the call when an elevator arrives to serve the call. Further, in continuous allocation, the allocation decisions can also be changed. For example, if the traffic situation and the estimated time of arrival to a call changes so that the number of passengers behind the call at the moment of serving the call exceeds the available space in the elevator that is currently allocated to the call, it can be allocated to another elevator.

In immediate allocation, a call is allocated to an elevator immediately after the call is registered and the serving elevator is signalized for the passenger or passengers who gave the call. This means that the allocation decision cannot be changed even if the traffic situation and the estimated time of arrival to the call would have changed so that the estimated number of passengers behind the call exceeds the available space in the elevator. Hence, the estimated time of arrival to the call and the historical passenger arrival intensity give a poor estimate for the number of passengers waiting behind the call. In immediate elevator call allocation, the amount of registered calls does not often correspond to the actual number of waiting passengers.

Based on the above, there is a need for a solution that would provide more accurate elevator allocation in a situation where there are multiple passengers behind a single call.

SUMMARY

According to a first aspect there is provided a method for allocating an elevator in an elevator system. The method comprises constructing passenger batch size distributions for each pair of floors in a building based on passenger batch journeys, each passenger batch journey defining at least the origin and destination floor of the journey, the number of passengers relating to the journey and the time of the journey; receiving a call for an elevator; estimating the number of passengers waiting behind the call based on the passenger batch size distributions; and allocating the call to an elevator being able to serve the estimated number of passengers.

According to a second aspect there is provided a computer program comprising program code, which when executed by at least one processor, performs the method of the first aspect.

According to a third aspect there is provided an elevator control apparatus comprising at least one processor; and at least one memory comprising computer program code for one or more programs, the at least one memory and the computer program code operating together with the at least one processor to cause the apparatus to perform at least the following: construct passenger batch size distributions for each pair of floors in a building based on passenger batch journeys, each passenger batch journey defining at least the origin and destination floor of the journey, the number of passengers relating to the journey and the time of the journey; receive a call for an elevator; estimate the number of passengers waiting behind the call based on the passenger batch size distributions; and allocate the call to an elevator being able to serve the estimated number of passengers.

According to a fourth aspect there is provided an elevator system comprising a plurality of elevators and an elevator control apparatus according to the third aspect arranged to allocate a call to an elevator.

BRIEF DESCRIPTION OF THE DRAWINGS

The accompanying drawings, which are included to provide a further understanding and constitute a part of this specification, illustrate embodiments and together with the description help to explain the principles. In the drawings.

DETAILED DESCRIPTION

Figure 1:
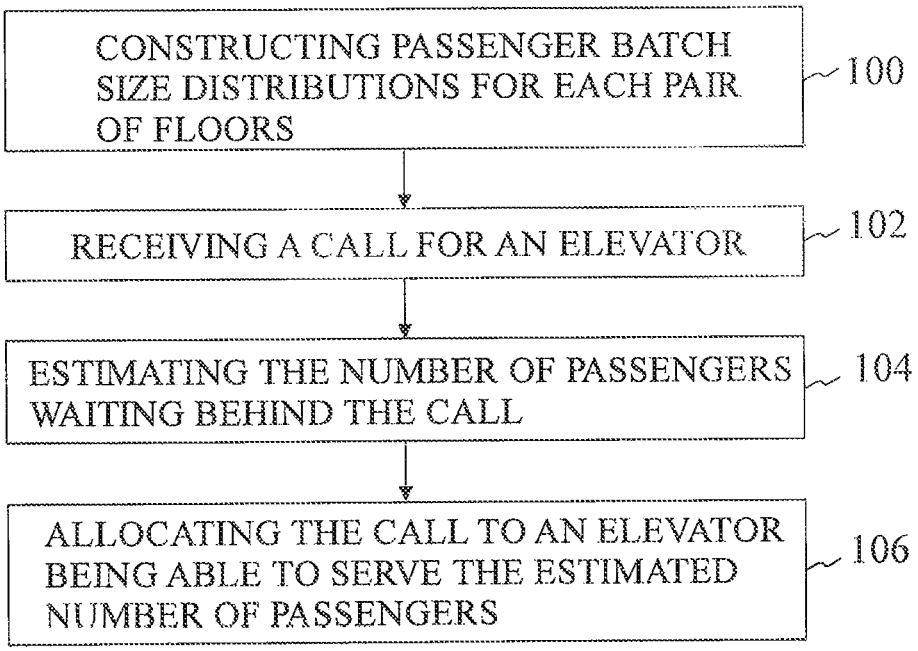
FIG. 1 is a flow diagram illustrating a method in accordance with one example embodiment.

FIG. 1 is a flow diagram illustrating a method in accordance with one example embodiment.

At 100 constructing passenger batch size distributions for each pair of floors in a building based on passenger batch journeys. Each passenger batch journey defines at least the origin and destination floor of the journey, the number of passengers relating to the journey and the time of the journey. The construction of the passenger batch size distributions may be performed by recording actual journeys from one floor to another and the number of passengers relating to each journey. In other words, the passenger batch size distributions are based on real passenger data. The passenger batch size distributions thus give detailed information on how and when people use elevators in a building. For example, normally when an elevator system receives a call, it assumes that there is a single passenger behind the call. The passenger batch size distribution, however, reflects the real amount of passengers. For example, people often go for lunch in a social batch and only one member of the batch gives the destination call. When the journey has been made, the recorded passenger batch distributions take into account the real amount of passengers. One possible solution for constructing passenger batch sizes is disclosed in a granted Finnish patent 121464B.

At 102 a call for an elevator is received. When the elevator system uses immediate allocation, the elevator system knows that a call from a passenger is from a specific origin floor to a certain destination floor. When the elevator system uses continuous allocation, the elevator system knows that the call from the passenger is from a specific floor and that it is either an up or down direction call.

At 104 the number of passengers waiting behind the call is estimated based on the passenger batch size distributions and at 106 the call is allocated to an elevator being able to serve the estimated number of passengers.

If the call is a destination call, the elevator system knows the origin floor, the destination floor and the time when the call was received. The elevator system uses this information to estimate the number of passengers waiting behind the call. For example, the call may have been received at 11:30 on Monday (lunch time) from an office floor to a floor having a restaurant or being an exit floor. The elevator system checks the passenger batch size distributions and from there it can be learned that the number of passengers behind a call matching these circumstances is, for example, four.

The elevator system may, for example, have two alternatives when allocating an elevator to a call. An elevator A has room for two passengers and its waiting time is 25 s. An elevator B has room for five passengers and its waiting time is 35 s. Since in the estimation it was estimated that there are four passengers behind the call, the elevator B is allocated although its waiting time is longer than with the elevator A.

If the call is a call in a continuous allocation elevator system, the elevator system knows the origin floor, the direction of the call (up/down) and the time when the call was received. For example, the call may have been received at 11:30 on Monday (lunch time) from an office floor (origin floor) to a floor having a restaurant or being an exit floor. The elevator system checks the passenger batch size distributions and from there it can be learned that the number of passengers behind a call matching these circumstances is, for example, three. The elevator system may, for example, have two alternatives when allocating an elevator to a call. An elevator A is arriving at the origin floor but it has room only for two passengers. An elevator B will arrive at the origin floor soon after the elevator A and it has room for four passengers. Since in the estimation it was estimated that there are three passengers behind the call, the elevator B is allocated for the passengers.

In a further example embodiment of FIG. 1, it is possible to compute the estimate for the number of passengers waiting behind a call as a type value, or parameter based on an average, a minimum or a maximum of at least one passenger batch size distribution relating to the call. Further, the estimate may also be any other parameter that can be calculated from the passenger batch size distribution.

In a further example embodiment of FIG. 1, from the passenger batch size distributions it is possible to construct other kind of distributions, for example, by simple summation. For example, the distribution for the passenger batch size from an origin floor to down direction and for a given time interval can be obtained by adding up the distributions for this origin floor and floors below it for this interval. In addition, the distributions can be learned in time and adjusted to possible traffic and population changes in a building by combining the distributions of successive days of a given week day using, for example, exponential smoothing.

At least one of the example embodiments provides an improvement over the earlier solutions since it can be used to estimate the number of passengers waiting behind a call independently of the estimated time of arrival to the call. This is important especially in immediate call allocation, where allocation decisions cannot be, changed even if it would be required by the changes in the traffic situation.

At least one of the example embodiments also provide an improvement in the allocation decisions made by the elevator control apparatus by estimating the space required by the passengers waiting behind a call. In particular, passenger service is improved, for example, at conference, restaurant and transfer floors where batch sizes vary throughout the day.

Figure 2:
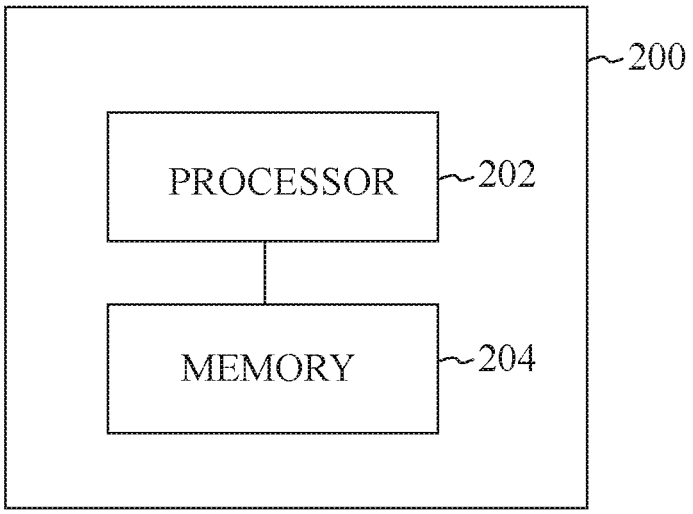
FIG. 2 is a block diagram illustrating an elevator control apparatus in accordance with one example embodiment.

FIG. 2 discloses a block diagram illustrating an apparatus 200 according to one example embodiment. The apparatus comprise a processor 202 connected to a memory 204. The apparatus may also comprise several processors or memories. The memory 204 or memories comprises computer program code for one or more programs which, when executed by the processor 202 or processors, the memory and the computer program code operating together with the processor to cause the apparatus 200 to perform at least the following: construct passenger batch size distributions for each pair of floors in a building based on passenger batch journeys, each passenger batch journey defining at least the origin and destination floor of the journey, the number of passengers relating to the journey and the time of the journey; receive a call for an elevator; estimate the number of passengers waiting behind the call based on the passenger batch size distributions; and allocate the call to an elevator being able to serve the estimated number of passengers.

Figure 3:
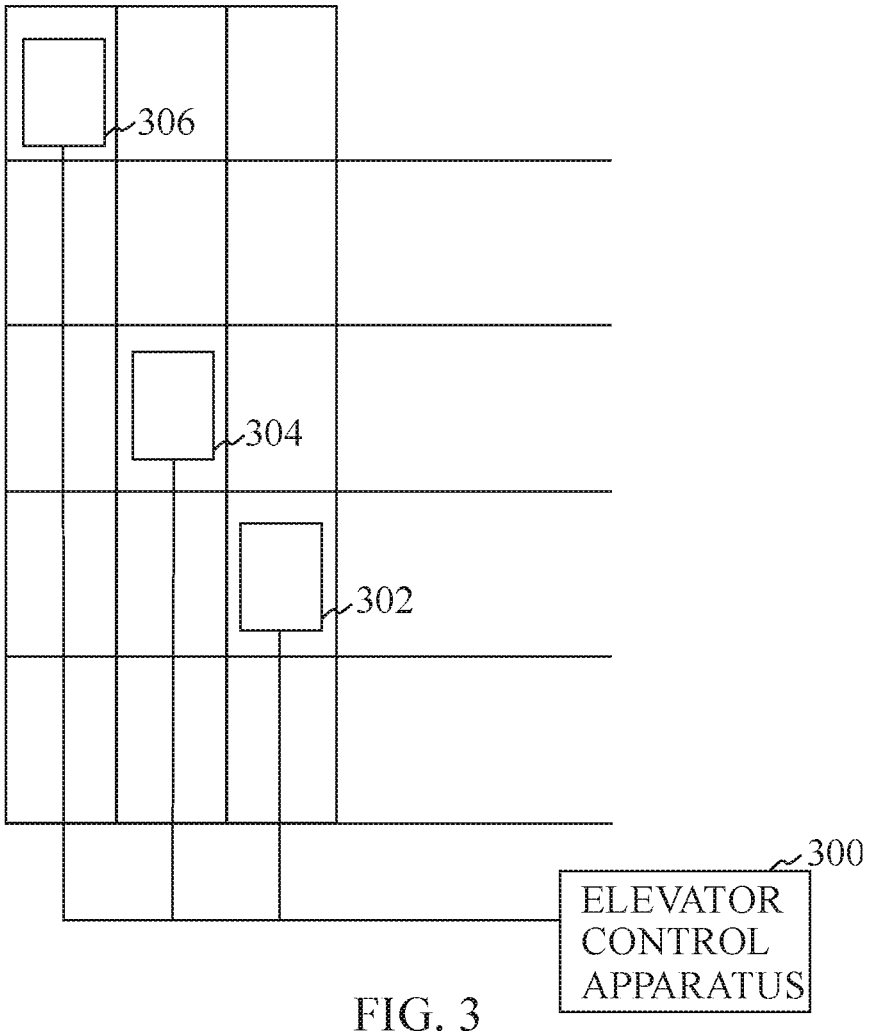
FIG. 3 is a block diagram illustrating an elevator system in accordance with one example embodiment.

FIG. 3 illustrates a system according to one example embodiment. The system in FIG. 3 is a simplified illustration of an elevator system. The system comprises an elevator control apparatus 300 which is responsible for controlling elevators 302, 304 and 306. The elevator control device 300 is configured to construct passenger batch size distributions for each pair of floors in a building based on passenger batch journeys, each passenger batch journey defining at least the origin and destination floor of the journey, the number of passengers relating to the journey and the time of the journey; receive a call for an elevator; estimate the number of passengers waiting behind the call based on the passenger batch size distributions; and allocate the call to an elevator being able to serve the estimated number of passengers.

According to one example embodiment there is provided an apparatus comprising means for constructing passenger batch size distributions for each pair of floors in a building based on passenger batch journeys, each passenger batch journey defining at least the origin and destination floor of the journey, the number of passengers relating to the journey and the time of the journey; means for receiving a call for an elevator; means for estimating the number of passengers waiting behind the call based on the passenger batch size distributions; and means for allocating the call to an elevator being able to serve the estimated number of passengers.

The example embodiments can be included within any suitable device, for example, including any suitable servers, workstations, PCs, laptop computers, capable of performing the processes of the example embodiments, and which can communicate via one or more interface mechanisms. The example embodiments may also store information relating to various processes described herein.

Example embodiments may be implemented in software, hardware, application logic or a combination of software, hardware and application logic. The example embodiments can store information relating to various methods described herein. This information can be stored in one or more memories, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein. The methods described with respect to the example embodiments can include appropriate data structures for storing data collected and/or generated by the methods of the devices and subsystems of the example embodiments in one or more databases.

All or a portion of the example embodiments can be conveniently implemented using one or more general purpose processors, microprocessors, digital signal processors, micro-controllers, and the like, programmed according to the teachings of the example embodiments, as will be appreciated by those skilled in the computer and/or software art(s). Appropriate software can be readily prepared by programmers of ordinary skill based on the teachings of the example embodiments, as will be appreciated by those skilled in the software art. In addition, the example embodiments can be implemented by the preparation of application-specific integrated circuits or by interconnecting an appropriate network of conventional component circuits, as will be appreciated by those skilled in the electrical art(s). Thus, the example embodiments are not limited to any specific combination of hardware and/or software.

Stored on any one or on a combination of computer readable media, the example embodiments can include software for controlling the components of the example embodiments, for driving the components of the example embodiments, for enabling the components of the example embodiments to interact with a human user, and the like. Such software can include, but is not limited to, device drivers, firmware, operating systems, development tools, applications software, and the like. Such computer readable media further can include the computer program of an example embodiment for performing all or a portion (if processing is distributed) of the processing performed in implementing the example embodiments. Computer code devices of the example embodiments can include any suitable interpretable or executable code mechanism, including but not limited to scripts, interpretable programs, dynamic link libraries (DLLs), Java classes and applets, complete executable programs, and the like. Moreover, parts of the processing of the example embodiments can be distributed for better performance, reliability, cost, and the like.

As stated above, the components of the example embodiments can include computer readable medium or memories for holding instructions programmed according to the teachings and for holding data structures, tables, records, and/or other data described herein. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

While there have been shown and described and pointed out fundamental novel features as applied to preferred embodiments thereof, it will be understood that various omissions and substitutions and changes in the form and details of the devices and methods described may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiments may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. A method for allocating an elevator in an elevator system, the method comprising:

constructing passenger batch size distributions for each pair of floors in a building based on passenger batch journeys, each passenger batch journey defining at least the origin and destination floor of the journey, the number of passengers relating to the journey and the time of the journey;

receiving a call for an elevator;

estimating the number of passengers awaiting the call based on the passenger batch size distributions; and allocating the call to an elevator being able to serve the estimated number of passengers;

wherein estimating the number of passengers waiting behind the call comprises estimating the number of passengers awaiting the call based on parameter determined from the passenger batch size distribution.

2. The method according to claim 1, wherein estimating the number of passengers waiting behind the call comprises:

estimating the number of passengers awaiting the call as a parameter value based on an average, a minimum or a maximum of at least one passenger batch distribution relating to the call.

3. The method according to claim 1, further comprising:

obtaining a particular passenger batch size distribution by combining multiple floor-wise passenger batch size distributions.

4. The method according to claim 1, wherein the elevator system provides continuous allocation service.

5. The method according to claim 1, wherein the elevator system provides immediate allocation service.

6. A computer program comprising program code, which when executed by at least one processor, performs the method of claim 1.

7. A computer program according to claim 6, the computer program is embodied on a computer readable medium.

8. An elevator control apparatus comprising:

at least one processor; and at least one memory comprising computer program code for one or more programs, the at least one memory and the computer program code operating together with the at least one processor to cause the apparatus to:

construct passenger batch size distributions for each pair of floors in a building based on passenger batch journeys, each passenger batch journey defining at least the origin and destination floor of the journey, the number of passengers relating to the journey and the time of the journey;

receive a call for an elevator;

estimate the number of passengers awaiting the call based on the passenger batch size distributions; and allocate the call to an elevator being able to serve the estimated number of passengers;

wherein estimating the number of passengers awaiting the call comprises estimating the number of passengers awaiting the call based on a parameter determined from the passenger batch size distribution.

9. The apparatus according to claim 8, wherein the at least one memory and the computer program code operating together with the at least one processor to cause the apparatus to perform at least the following:

estimate the number of passengers waiting behind the call as a parameter value based on an average, a minimum or a maximum of at least one passenger batch distribution relating to the call.

10. The apparatus according to claim 8, wherein the at least one memory and the computer program code operating, together with the at least one processor to cause the apparatus to:

obtaining a particular passenger batch size distribution by combining multiple floor-wise passenger batch size distributions.

11. The apparatus according to claim 8, wherein the elevator system provides continuous allocation service.

12. The apparatus according to claim 8, wherein the elevator system provides immediate allocation service.

13. An elevator system comprising:

a plurality of elevators; and an elevator control apparatus of claim 8 arranged to allocate a call to an elevator of said plurality of elevators.

14. The method according to claim 2, further comprising:

obtaining a particular passenger batch size distribution by combining multiple floor-wise passenger batch size distributions.

15. The method according to claim 2, wherein the elevator system provides continuous allocation service.

16. The method according to claim 3, wherein the elevator system provides continuous allocation service.

17. The method according to claim 2, wherein the elevator system provides immediate allocation service.

18. The method according to claim 3, wherein the elevator system provides immediate allocation service.

19. A computer data storage medium having a computer program comprising program code stored thereon, which when executed by at least one processor, performs the method of claim 2.

20. A computer data storage medium having a computer program comprising program code stored thereon, which when executed by at least one processor, performs the method of claim 3.

* * * * *